US010501153B2

(12) United States Patent
Mohrman et al.

(10) Patent No.: US 10,501,153 B2
(45) Date of Patent: Dec. 10, 2019

(54) SAFETY ANCHOR ENCLOSURE

(71) Applicants: Robert A Mohrman, St. Louis, MO (US); Daniel P Mohrman, St. Louis, MO (US)

(72) Inventors: Robert A. Mohrman, Ellisville, MO (US); Daniel P Mohrman, Chesterfield, MO (US)

( * ) Notice: Subject to any disclaimer, the term of this patent is extended or adjusted under 35 U.S.C. 154(b) by 0 days.

(21) Appl. No.: 16/032,000

(22) Filed: Jul. 10, 2018

(65) Prior Publication Data

US 2019/0135383 A1 May 9, 2019

Related U.S. Application Data

(60) Provisional application No. 62/532,078, filed on Jul. 13, 2017.

(51) Int. Cl.
*B63B 21/00* (2006.01)

(52) U.S. Cl.
CPC ..... *B63B 21/00* (2013.01); *B63B 2021/003* (2013.01)

(58) Field of Classification Search
CPC ..... B63C 9/26; B63B 21/00; B63B 21/227
See application file for complete search history.

(56) References Cited

U.S. PATENT DOCUMENTS 735,985 A * 8/1903 Kidd ..... B63B 21/14 114/179
2,498,113 A 2/1950 Milner
2,903,989 A * 9/1959 Winslow ..... B63B 21/14 114/179
3,870,875 A 3/1975 Altimus
3,977,448 A * 8/1976 Botting ..... B63B 21/22 114/210
3,993,016 A 11/1976 Pulaski
4,004,625 A 1/1977 Zietlow, Jr.
4,168,778 A * 9/1979 Buxton ..... B65D 85/676 206/397
4,576,281 A * 3/1986 Kirksey ..... A61M 5/3205 206/366
4,805,800 A * 2/1989 Nocek ..... B65D 83/0894 206/554
5,072,683 A 12/1991 Colonna
5,137,481 A 8/1992 Wengler
5,138,728 A * 8/1992 Aston ..... A47C 21/00 5/645

(Continued)

*Primary Examiner* — Stephen P Avila
(74) *Attorney, Agent, or Firm* — Rebecca J. Brandau

(57) ABSTRACT

A safety enclosure for a boat anchor prevents injury to persons moving about in the vicinity of the anchor when the boat is docked. The enclosure has an openable top, a bottom which is flexible along a longitudinal axis, and sides which open at each end of the opening of the top. An aft end of the enclosure defines an opening for receiving the shaft of an anchor on a boat. The enclosure is formed of a sheet of a durable, pliable material and a padding layer sufficiently strong and thick to withstand repeated flexing and continual contact with heavy, sharp metal of an anchor and to prevent serious harm to a person who movingly contacts the enclosed anchor. Such construction permits opening of the enclosure in a clamshell manner for secure, but quick, facile placement of the enclosure around a boat anchor or removal there from.

23 Claims, 5 Drawing Sheets

(56) References Cited

U.S. PATENT DOCUMENTS

| | | | | |
|---|---|---|---|---|
| 5,205,234 | A * | 4/1993 | Schoell | B63B 21/14 114/210 |
| 5,273,399 | A | 12/1993 | Ojeda | |
| 5,524,569 | A | 6/1996 | Rich | |
| 5,660,136 | A | 8/1997 | Pignatelli et al. | |
| 5,664,975 | A | 9/1997 | Carlisle | |
| 6,055,923 | A | 5/2000 | Militzer | |
| 6,152,064 | A | 11/2000 | Morton | |
| 6,471,120 | B1 * | 10/2002 | Vogel | B65D 5/0227 229/117.16 |
| 6,623,206 | B1 * | 9/2003 | Blair | G08G 1/02 404/12 |
| 6,736,686 | B2 | 5/2004 | Miller | |
| 6,916,217 | B1 | 7/2005 | Crepeau | |
| 7,156,711 | B2 | 1/2007 | Hutchings | |
| 7,377,227 | B2 | 5/2008 | LaRoche | |
| 8,070,541 | B2 | 12/2011 | Novack | |
| 2005/0247587 | A1 * | 11/2005 | Holland-Letz | B25H 3/003 206/373 |

* cited by examiner

SAFETY ANCHOR ENCLOSURE

CROSS-REFERENCE TO RELATED APPLICATION

This application relies upon and claims the benefit of priority of the filing date of U.S. Provisional Patent Application 62/532,078, filed Jul. 13, 2017, the entirety of which is incorporated herein by reference.

FIELD OF THE INVENTION

The present invention relates, generally, to safety devices for protecting persons from being harmed by a raised anchor extending from a boat over a boat dock; and more particularly, to a light-weight, easily manipulated enclosure which can be quickly and securely applied around a raised anchor to reduce the risk to passers-by on the boat dock incurring accidental injury due to contact with the anchor.

BACKGROUND AND SUMMARY OF THE INVENTION

Boats of most types, due to their nature of being vehicles, which are often motorized and intended to be operated on open bodies of water, present numerous possible hazards. This is the reason that marinas commonly require customers who wish to dock a boat in a marina's slip to provide proof of a significant amount of liability insurance. The insurance is intended to protect the boat owner/operator and the marina from possible legal claims in the event of an accident involving the boat resulting in damage or harm to people and their property. One of these potential sources of damage, particularly involving physical injury to a human being, is presented by the anchor of a boat.

The new anchor enclosure described and claimed herein is the first such device of its type providing such useful safety applications. It requires no assembly after purchase and is simple and fast to install for use on a conventional boat anchor, as may be found in any commercial or private dock, on multiple types of watercraft. The new safety anchor enclosure device features a tough, water-resistant, weather-resistant highly reflective outer surface and a high-density, but light-weight and floatable, interior padding substance. The "clamshell" style structure of the new anchor enclosure is such that it can be quickly and easily, yet very securely applied to an anchor on a docked boat. It also permits facile removal from the site of use for storage on the dock, when leaving the slip, or even on board the boat, if preferred. The new enclosure device is a handy, compact, light-weight unit for ready accessibility and reapplication to the anchor of the boat at dock.

A boat anchor, by its nature is commonly a heavy, strong device attached to a boat for selective dropping into a body of water to prevent uncontrolled drift of the attached boat. For best function anchors generally are provided with multiple sharp edges which facilitate engagement of the anchor on the floor of the bottom of the body of water. However, when the anchor is raised at the bow of the boat and the boat is docked, the anchor can extend above the surface, inwardly toward the center of the dock, so as to present a significant hazard to persons moving about on the dock. For example, an inadvertent collision of a person's shin with an anchor could result in an extremely serious injury to the person's leg, resulting in a great deal of pain, loss of blood and at least temporary loss of use of the leg. Of course the potential for injury to a running child could be much worse.

Accordingly, there has been a long-felt need in the industry for an economically manufactured, yet very sturdy, protective safety device to protect people who may be unaware of a projecting anchor and who may easily come into dangerous contact therewith. The new device has a very acceptable cosmetic appearance, while still providing the owner of the boat and of the owner of the dock with significant risk reduction by reliably protecting people from harm due to contact with a boat anchor which has been covered by the new enclosure.

Moreover, the new safety anchor enclosure is easily applied to an anchor and secured thereto in such manner that the anchor is completely covered, and cannot inadvertently become dislodged from the anchor. The new device is substantially water-tight, weather-resistant and mildew resistant. The new anchor enclosure can even be locked onto the anchor in order to discourage theft of the anchor enclosure. Although the new anchor enclosure is light-weight enough to be readily carried by one person, even a child, it is not intended to be a portable item, because the anchor per se would not ordinarily be carried to and from the boat. Rather, the new anchor enclosure is intended to be kept on the boat anchor, operatively covering it, whenever the boat is either docked or in storage. At any other time the new enclosure is kept in storage on or near the dock, or even on the boat.

Thus, in keeping with the purpose and advantages of the invention, the present device is, briefly, a safety enclosure for a boat anchor to prevent injury to persons moving about in the vicinity of the anchor when the boat is docked. The safety anchor enclosure has an openable top, and a bottom which is flexible along a longitudinal axis of the bottom. A first side extends from the top to the bottom and a second side opposite the first side also extends from the top to the bottom. A first end extends over an area defined by aft edges of the top, the bottom, the first side and the second side. A second end opposite the first end extends over an area defined by forward edges of the top, the bottom, the first side and the second side. The first end is positioned aft and defines an opening for receiving the shaft of an anchor on a boat. The second end is positioned forward when the enclosure is in operative position enclosing the anchor of a boat. The safety anchor enclosure is formed of at least one sheet of a durable, pliable material sufficiently strong to withstand repeated flexing and continual contact with heavy, sharp metal of a type forming an anchor of a boat. There enclosure material is also padded thickly enough to prevent serious harm to a person who movingly contacts the safety enclosed anchor. The safety anchor enclosure also has at least one mechanism for securing the enclosure in a closed configuration when it is in operative position on the anchor of a boat.

The invention is also, briefly, the above safety anchor enclosure, wherein the openable top has a first portion and a second portion. The first top portion and the second top portion are similarly sized and shaped, and each has a forward edge and an aft edge. The first top portion and the second top portion each have an inner edge not connected to the inner edge of the other top portion; and each have an outer edge. The first top portion and the second top portion are positioned side by side, with the openable top being closed when the anchor enclosure is in a closed configuration around an anchor.

The invention is also, briefly, the described enclosure, wherein the first side and the second side each have an upper edge and a lower edge. The first side is positioned port and the second side is positioned starboard when the safety enclosure is in normal operative position enclosing the anchor of a boat. Further, the outer edge of the first top portion is connected to upper edge of the first/port side and the outer edge of the second top portion is connected to the upper edge of the second/starboard side.

The invention is still further, briefly the safety anchor enclosure above, wherein the enclosure bottom has an aft edge, a forward edge, a port edge and a starboard edge, in relation to the position of the safety enclosure in normal use position. The enclosure bottom has an internal hinge extending from the aft end to the forward end along a central longitudinal axis of the enclosure bottom to facilitate longitudinal flexing of the bottom. The first end of the enclosure and the second end of the enclosure are each divided longitudinally into a first/port end portion and a second/starboard end portion. The first and second end portions of each end are formed of similar sizes and shapes as the other portion of the respective pair. The first portion and the second portions of each of the first/aft end and the second/forward end each have an upper edge, a lower edge, an inner edge, and an outer edge, the inner edges of each end portion pair being adjacent in the operative enclosure position, but selectively separable from one another. The inner edges of the first aft end portions are substantial mirror images of each other, each defining a half of an opening, so as to form a complete opening when the first aft end portions' inner edges are adjacent. Constructed in this manner, the upper edge of the first aft end portion is connected to the aft edge of the first/port top portion, and the upper edge of the second aft end portion is connected to the aft edge of the second/starboard top portion. The lower edges of both the first and second aft end portions connect side-by-side to the aft edge of the enclosure bottom. The outer edge of the first aft end portion is connected to the aft edge of the port side and the outer edge of the second aft end portion is connected to the aft edge of the starboard side. Moreover, the upper edge of the first forward end portion is connected to the forward edge of the first/port top portion, and the upper edge of the second forward end portion is connected to the forward edge of the second/starboard top portion. The lower edges of both the first and second aft end portions connect side by side to the forward edge of the enclosure bottom. The outer edge of the first forward end portion is connected to the forward edge of the port side and the outer edge of the second forward end portion is connected to the forward edge of the starboard side. Further, the upper edge of the second/forward end portion connects to the forward edge of the second top portion, and the upper edge of the starboard side connects to the outer edge of the second top portion, and the aft edge of the second top portion connects to the upper edge of the second/aft end portion. So constructed, the safety anchor enclosure has one continuous selectively separable line of intersection of the two aft end portions, the two top portions and the two forward end portions contiguously with the internal hinge formed in the enclosure bottom, to thereby permit the safety anchor enclosure to be easily, repeatedly, and selectively opened and closed in a clamshell manner to enclose an anchor on a boat for safety at a boat dock, and to be selectively removed from the anchor when the boat is to leave the dock.

Further details and features of the present invention will become apparent from the detailed description provided hereinafter. It should be understood that the drawings, detailed description and specific examples herein, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Throughout the drawings like parts are indicated by like element numbers. Not all elements are shown in all drawings.

DETAILED DESCRIPTION OF THE PREFERRED EMBODIMENT

Figure 1:
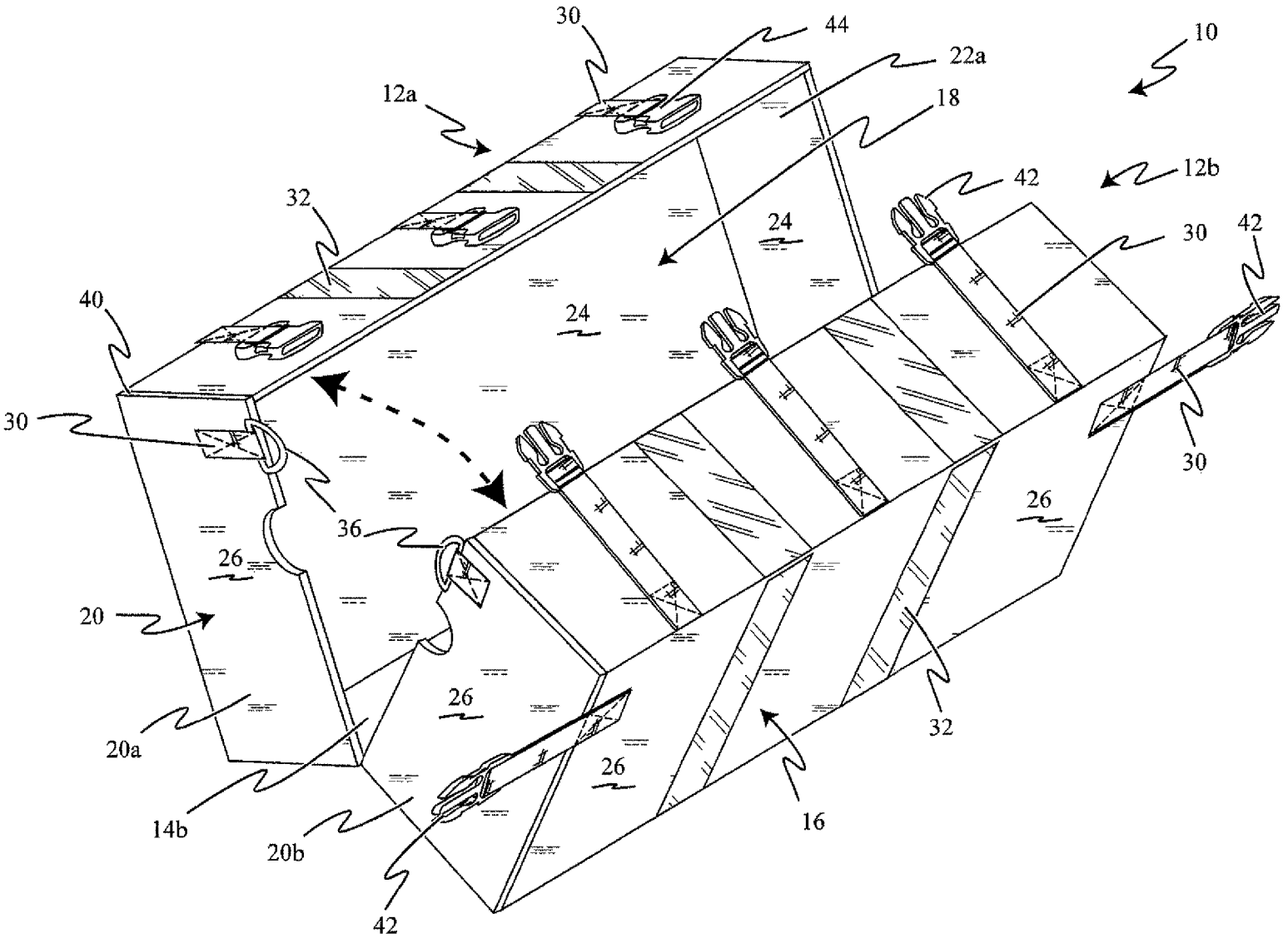
FIG. 1 is an upper, forwardly directed perspective view of an anchor enclosure safety device constructed in accordance with and embodying the present invention in open position and showing the aft end and starboard side of the enclosure.

With reference to the attached illustrations, FIGS. 1-6, a safety anchor enclosure, generally designated 10, is shown as a substantially flat-sided container having portions including a top 12, bottom 14, opposed sides 16, 18 and opposed ends 20, 22. The anchor enclosure 10 is preferably formed of a central "body" layer 25, which is formed in part of a preferably floatable padding substance, such as high-density foam. Although other forms may be useful and in keeping with the invention, it is especially preferred that body layer 25 is provided in the form of one or more pliable sheets of such high-density foam. The padding layer 25 is preferably coated, covered, laminated or otherwise sandwiched between an inner surface layer 24 and an outer surface layer 26, as illustrated schematically in FIG. 3. It is possible, however, that enclosure 10 will still function with only one of the two surface layers, or even no surface layers, but the appearance may be less desirable and certainly the longevity of the product would be reduced.

The material of which inner surface 24 and outer surface 26 are formed is pliable, durable and preferably at least water resistant, or even substantially water-proof, as well as being mildew resistant. Although non-water resistant fabric could suffice for the outer and inner layers, such are not preferred because of the humid environment in which enclosure 10 is to be used. In construction of enclosure 10 surfaces 24, 26 are applied securely and entirely over and around the body material 25, preferably as sheets of a substance which can be sewn, glued, or otherwise securely applied, enveloping the padding layer 25. A particularly preferred material for forming the inner surface 24 and outer surface, 26 is 18 oz vinyl chloride plastisol ("VCP"). Other examples of potentially useful materials for layer 24 and/or layer 26 are rip-stop nylon fabric and a puncture resistant fabric available under the registered trade name Gortex®. Surface layers 24, 26 may also be applied to the central padding layer 25 as a coating, such as, for example, a liquid which upon application becomes a solid or semi-solid seal entirely around the middle, padding layer 25. Other suitable surface materials exist, or may yet be developed, which can also be useful in keeping with the purpose of the invention, the safety of individuals moving about in the vicinity of a boat anchor.

FIG. 1 illustrates a preferred configuration of safety anchor enclosure 10, having an overall box shape with a generally flat top portion 12 formed of two portions 12*a*, 12*b* of similar size and shape. Top portions 12*a*, 12*b* are disposed side by side in substantially the same plane when enclosure 10 is in normal operative position, meet preferably at their inwardly directed edges along a longitudinal top axis of enclosure 10, but are also selectively separable from one another. Top portions 12*a*, 12*b* are attached longitudinally along respective outer edges thereof to corresponding enclosure sides 16 (starboard), 18 (port), respectively, along the upper extent of each side portion 16, 18. Side portions 16, 18 are attached longitudinally along the lower edges thereof to the starboard and port edges, respectively, of enclosure bottom 14. Further details of construction will be discussed later, hereafter with reference to FIG. 6.

Figure 2:
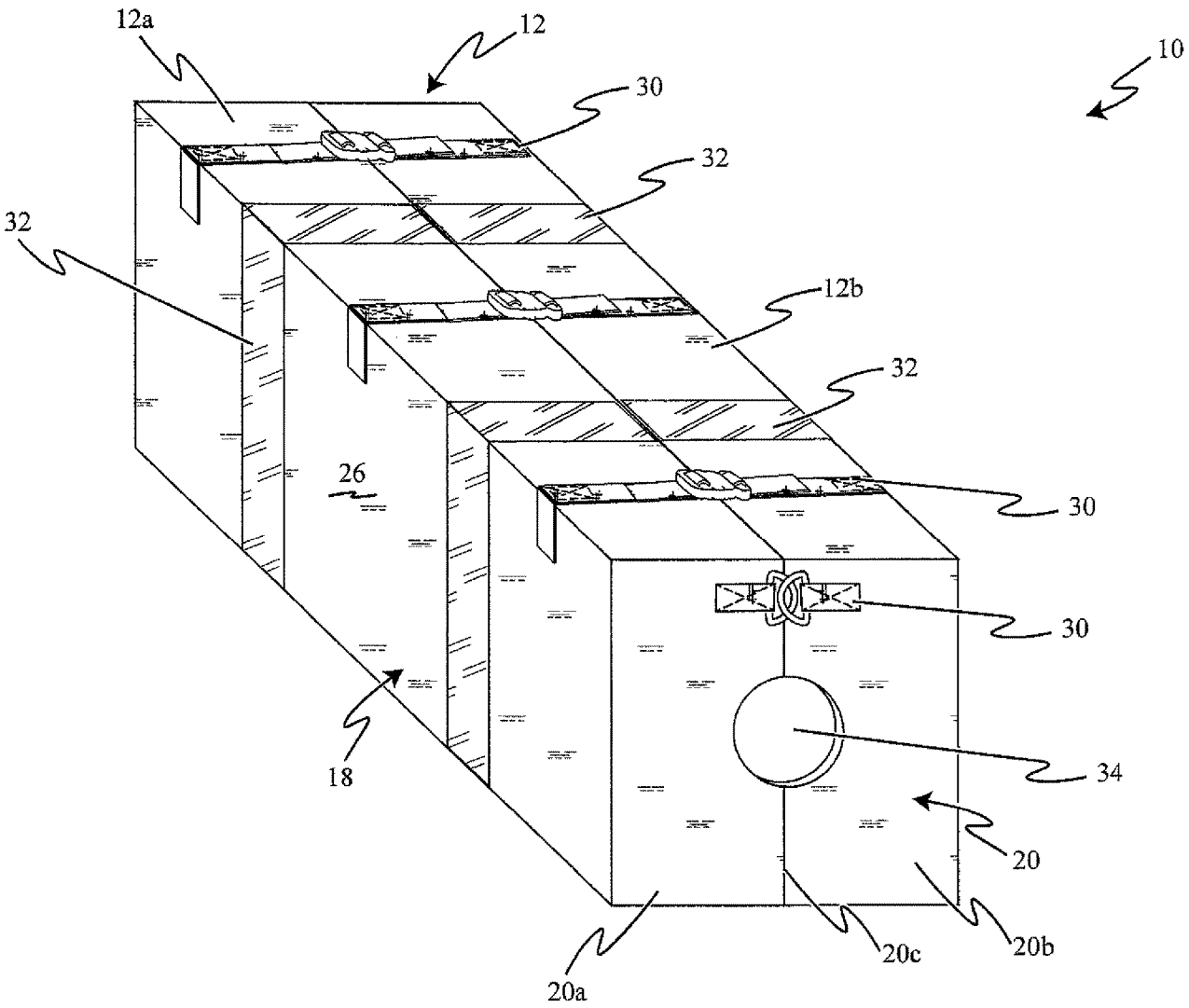
FIG. 2 is a forwardly directed perspective view of an alternative embodiment the anchor enclosure of FIG. 1, in closed position, showing the port side of the enclosure and the aft end that faces the boat when the anchor enclosure is mounted in operative position on an anchor.
Figure 3:
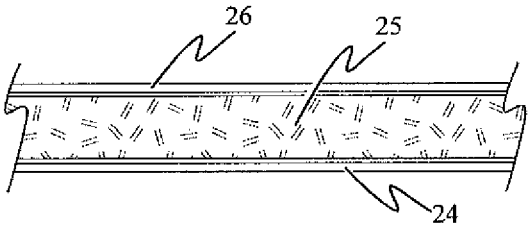
FIG. 3 is a sectional view of the piece of the body material of the anchor enclosure of FIG. 1, showing the inner cushioning layer sandwiched between two layers of surface material.

FIG. 1 and FIG. 2 both illustrate the aft (back) end 20 of anchor enclosure 10, which faces the boat when in operative position on an anchor. End 20 is formed of two portions, 20*a*, 20*b* which selectively meet each other along a substantially central vertical axis ("line of meeting"), when enclosure 10 is in operative use position. Likewise, forward end 22 and top 12 are each formed of corresponding and similar sub-portions a, b which can be repeatedly selectively separated away from one another or moved back together to open and close the new safety enclosure 10 along a longitudinal axis of top portion 12, thus creating a "clamshell" type enclosure for ease of installation and removal.

Figure 4:
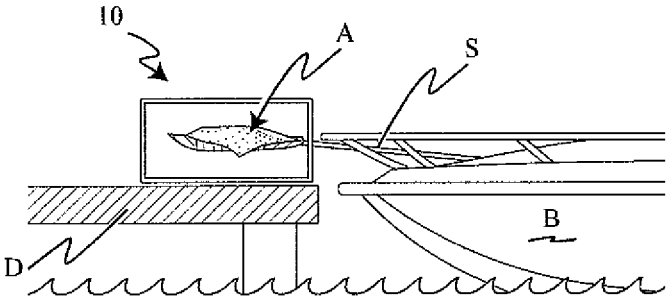
FIG. 4 is a schematic illustration of the anchor enclosure of FIG. 1 mounted on an anchor extending from the bow of a boat and over the walkway of a dock at which the boat is moored, with the anchor enclosure shown in longitudinal section.

In FIG. 1 anchor safety enclosure 10 is shown in the open configuration, as to receive an anchor into open top 12. Enclosure 10 is shown closed in FIG. 2, with top 12 being closed, with the two portions 12*a*, 12*b* meeting substantially along a central longitudinal axis of top 12. In each case, end 20 is formed of two end portions 20*a*, 20*b*, which each define a segment of an aperture or opening, generally designated 34, along the midline where portions 20*a*, 20*b* meet. Opening 34 accommodates the shaft S of anchor A when enclosure 10 is mounted in operative protective use position on the anchor attached to boat B, as seen in FIG. 4. While the opening indicated at 34 is illustrated as being round, and of a relatively small dimension as compared to the combined areas of end portions 20*a*, 20*b*, it should be understood that the shaft connecting the anchor to the boat may have a differently shaped and sized cross-section. For example, shaft S may be formed of a rectangular piece of metal extending from the anchor and secured to the boat. In that case, the enclosure opening 34 can still be round if its diameter is large enough to permit opening 34 to receive the longest dimension of a cross-section of rectangular shaft S. Alternatively, opening 34 could be defined as a rectangle, if of sufficient size to receive the cross-sectional dimensions of the shaft in use. There may also be occasions wherein the anchor and shaft structure is such that it is necessary for opening 34 to be defined either higher or lower along the meeting edges of end portions 20*a*, 20*b* of anchor enclosure 10.

FIG. 4 schematically illustrates anchor enclosure 10 in longitudinal section, from the starboard side, with top 12 closed. This is the operative position of anchor enclosure 10 relative to the anchor A mounted on docked boat B and jutting out above the walk portion of dock D, as shown.

Figure 5:
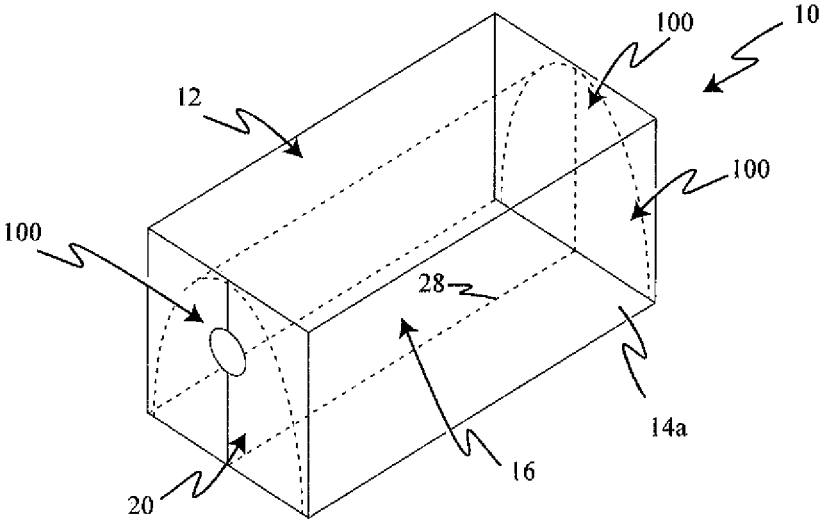
FIG. 5 is a schematic perspective view of the anchor enclosure of FIG. 1, with the enclosure being in closed position and showing in broken lines an alternative, arced configuration of the top and sides of the anchor enclosure.

Forward (front) end 22 of enclosure 10 is illustrated in FIG. 5, and is constructed in the formed product the same as aft end 20, with the exception that forward end 22 does not define an opening for the anchor shaft. Rather, forward end 22 is formed of two solid portions 22*a*, 22*b*, which meet entirely along a vertical midline of end 22 when enclosure 10 is closed. Paired forward end portions 22*a*, 22*b* can be selectively spatially separated from each other along their shared line of meeting, in the same manner as aft end portions 20*a*, 20*b*; i.e. they will necessarily separate from each other as the two top portions 12*a*, 12*b* are separated to place an anchor within enclosure 10 or remove the enclosure from an anchor. This open position of anchor enclosure 10 is clearly shown in FIG. 1. The figure is not intended to impose any limitation upon the degree to which enclosure 10 can be opened. Further, for simplicity of the drawings the edges of the openings of anchor enclosure 10 are shown as bare edges. However the respective intersections of paired end 20, 22 and top 12 portions of the anchor enclosure body are more water resistant if they are provided with overlapping or sealing flanges or otherwise closed or pressed together when anchor enclosure 10 is in its operative working condition. As anchor enclosure 10 is not intended to be submerged when covering the anchor a water-tight seal is not required to accomplish the safety purpose of the invention. Nonetheless, if desired, a sealing flange can be provided along the otherwise open edges of enclosure 10, and even around opening 34.

FIG. 5 illustrates in broken lines one conceivable alternative configuration 100 of the present invention, wherein the flat top portions 12*a*, 12*b* and the substantially vertical side portions 18,16, respectively, are effectively combined into one piece on each long side of the alternative enclosure, to provide an arced covering wherein two side portions extend upwardly, one from each outer edge of bottom 14 and then arc centrally until meeting along a longitudinal axis at the top of enclosure 100. In other respects alternative construction 100 is the same as enclosure 10. Because the semi-oval ends of enclosure 100 are each split vertically and centrally, and they are connected at their bottom edges to opposed ends of bottom 14, as the two arced top/side portions of enclosure 100 are selectively separated, the attached bottom 14 flexes along the central invisible hinge 28, in the same clamshell manner as does safety anchor enclosure 10.

Figure 7:
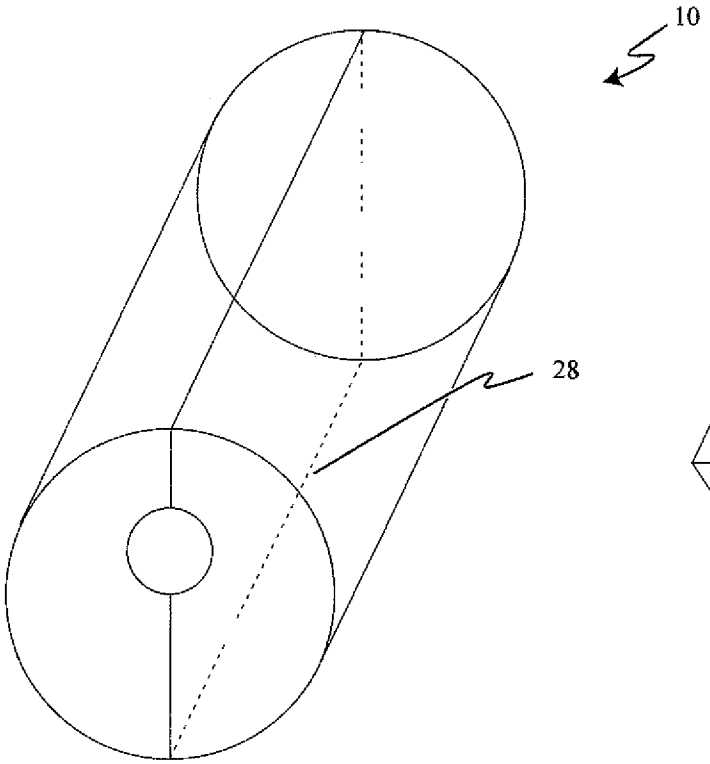
FIG. 7 is a perspective view of an alternative configuration of the new safety anchor device in a triangular prism form.

Other alternative shapes may be conceived that will be constructed and function in keeping with the safety device described and claimed, such as the configuration illustrated in FIG. 7, having a flat top, flat sides which angle toward the internal hinge on the central longitudinal axis and triangular split opposed ends.

Figure 8:
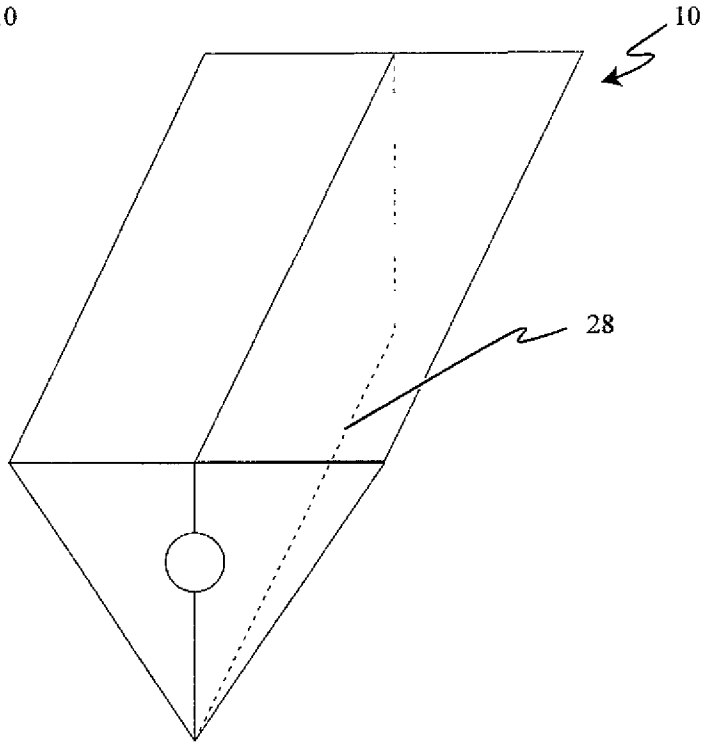
FIG. 8 is a perspective view of a further alternative configuration of the new safety anchor device in a barrel shaped form.

Another possible embodiment, not illustrated, is similar to embodiment 100 (with half oval ends), but more so. That is, the arched top portion configuration can also be utilized as a variant on the construction of the bottom portion of the anchor enclosure, so as to provide the enclosure with a more or less tube or barrel shape, as illustrated in FIG. 8, with substantially circular ends. Such a configuration of safety anchor enclosure 10 would have the same clamshell action when opening and closing but with curved top, bottom and side portions instead of flat. Just as in the construction of safety anchor enclosure 10, as the enclosure top is opened and closed the paired portions of the opposed ends of the enclosure and the sides attached to the bottom and paired end portions will simultaneously open, or move away from each other. In each case a longitudinal invisible hinge 28 disposed opposite a complete longitudinal opening aligned with split ends will permit the enclosure to be opened and closed quickly and easily in a clamshell manner to provide an opening sufficiently large to readily accept the awkward shape and size of an anchor. Thus, each of these examples of alternative embodiments is in keeping with the teachings of the present invention and can be adapted with all of the additional features of the invention as discussed above and below.

Figure 6:
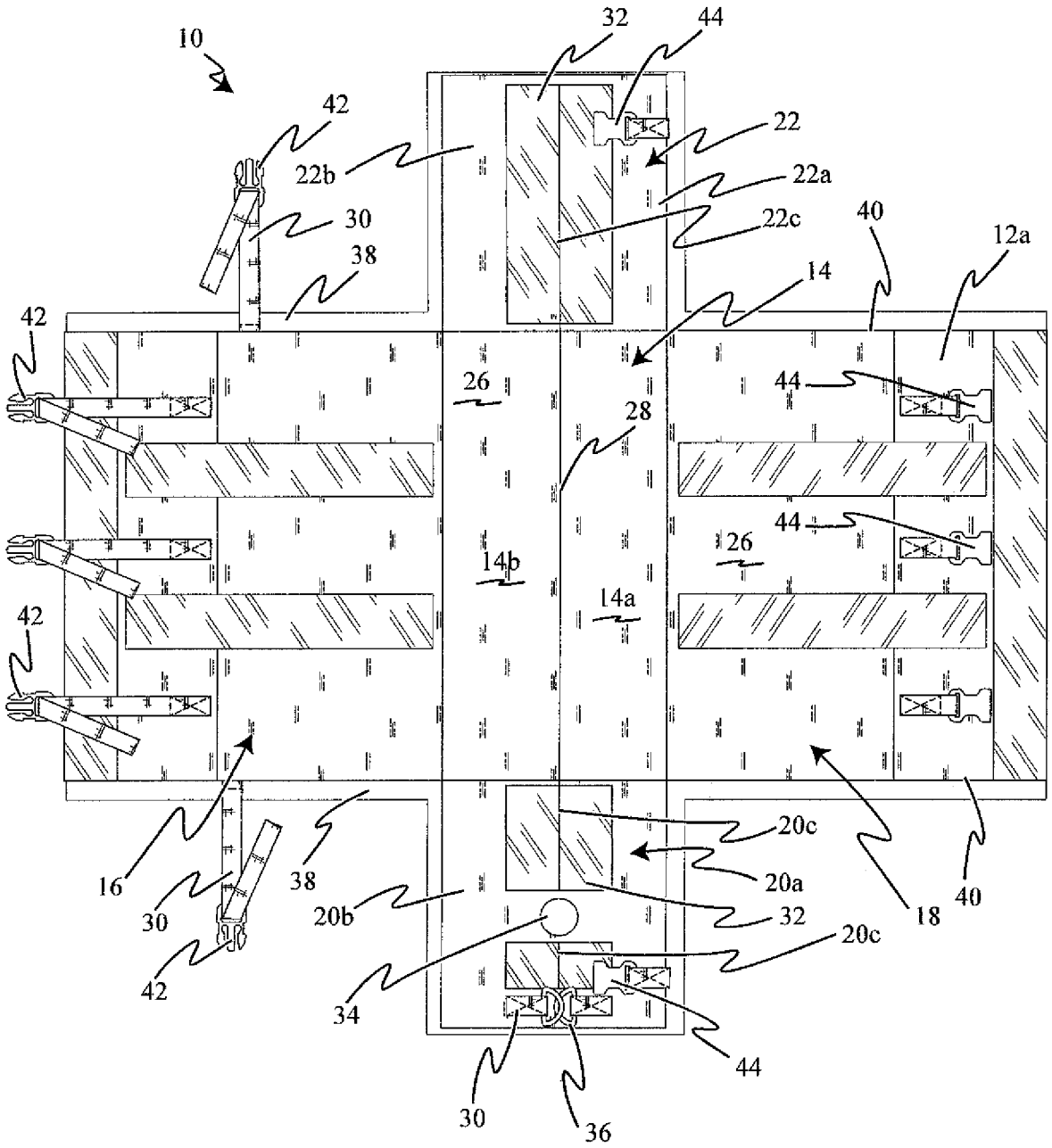
FIG. 6 is a plan view of a flattened template for constructing the anchor enclosure of FIG. 1, showing the outer surfaces of the enclosure, and illustrating a practical placement of adjustable quick-release straps for keeping the device reliably closed, and of reflective tape to enhance visibility of the enclosure.

As seen in FIG. 6, bottom portion 14 of anchor enclosure 10 is, in the preferred embodiment, generally rectangular and formed with a line of weakness or "internal hinge" 28 along central longitudinal axis to permit bottom 14 to flex downwardly lengthwise and thereby facilitate continuous separation of top halves 12*a*, 12*b* from one another. Internal hinge 28 can be made by forming bottom portion 14 of the enclosure body with two separate pieces of high-density foam or padding in layer 25, in substantially same-size rectangles placed side by side within the layers of the inner surface 24 and outer surface 26. Other useful constructions of the internal hinge will be apparent to one skilled in the art. This longitudinally flexible bottom construction, provided by the internal hinge 28, combined with the fully separable paired top portions and separable paired end portions, provides the user with the ability to easily open enclosure 10 like a clamshell. It should be noted that various constructions of internal hinge 28 are known or can be conceived which are suitable and in keeping with the invention.

FIGS. 1, 2 and 6 illustrate some useful positions for a plurality of straps 30, and lengths of reflective tape 32. Straps 30 are illustrated in the configuration of FIG. 2 as being formed of overlapping strips of hook and loop fastener material, such as that available under the registered trademark name, Velcro®. This will provide a secure mechanism for repeatedly closing and opening the anchor enclosure 10.

FIGS. 1 and 6 illustrate another, more preferred construction of straps 30. In this case straps 30 are formed of a strong nylon webbing which is attached to enclosure 10 by sewing at predetermined intervals along the top and along each end of enclosure 10. Regardless of the material of the straps, it is generally preferred to have more than one strap 30 which secures the top portion 12 of the anchor enclosure, and at least one strap across each of the forward end 22 and the aft end 20. The exact location of straps 30 relative to each other and to the overall dimensions of enclosure 10 can vary, but it is preferred that the securing straps 30 which extend over top portion 12 be spaced apart from each other by a number of inches, in a uniform manner, in order to provide a complete, even secure closing of the top portion 12. Similarly, the positions of straps 30 on ends 16, 18, shown in FIG. 6 are the approximate preferred placement for best closure and securement of end portions 20, 22 when enclosure 10 is in the operative position mounted on an anchor.

In FIG. 6 it will also be noted that the preferred straps 30 are provided with a quick-release buckle arrangement. As shown, the male portion of the buckles are adjustably mounted on straps 30 connected to top portion 12*b* and the female portion of the buckles are fixedly mounted on straps 30 connected to top portion 12*a*. This configuration of the straps and buckles permits the user of enclosure 10 to simply and quickly connect the series of buckles along the length of top portion 12 and to the quick release clips spaced along top portion 12*b*. The adjustable male portion buckles can then be readily moved along their corresponding securing straps to whatever tightness or placement is desired by the user. In similar fashion the male and female buckle parts are disposed upon the enclosure to secure the closure of end portions 20, 22. More specifically, at each end portion 20, 22, a strap 30 is provided for attaching a male buckle portion 42 to each upper corner of side 26. A female buckle portion is secured to an upper portion of each aft portion 26*a* for rapid connection of all open, facing edges of the two sides of the enclosure. Much of this process of rapid connection of the buckles, adjustment of the straps and subsequent release of the buckles can often be accomplished with one hand, permitting the user to have their other hand available to support enclosure 10 in position for attachment to or release from an anchor.

It is preferred that the quick-release, adjustable buckles or "clips" be formed of a durable plastic although some other materials may suffice. While still being within the scope of the invention, such other buckle or different closure mechanism materials may be less desirable if subject to rusting, rot, or breakage. The preferred closure mechanism described and shown permits the straps to be rapidly secured and adjusted for length, as however might be desired to provide overlap of the facing edges of top portions 12*a*, 12*b*, or of the facing edges of end portions 16*a*, 16*b* and 18*a*, 18*b*, or to better accommodate the size of a particular anchor.

For further securing enclosure 10 around the anchor, a padlock (not shown) of known variety, can be used to connect straps 30, for example, by forming loops in the material at ends of the hook and loop material straps, which loops can be locked together to secure aft end 20 around the anchor shaft. Alternatively, the strap loops can be replaced by metal rings secured by sewing into the strap ends, regardless of the material of the straps.

FIGS. 1 and 6 also illustrate useful optional positions on anchor enclosure 10 for application of highly reflective material, shown as strips of tape 40, to ensure both day and night visibility, to thereby reduce risk of liability to the boat owner, as well as the dock owner, from personal injury to a pedestrian on the boat dock. The reflective material, however, can be of shapes other than strips and can be arranged in any design and location desired, as long as the purpose of enhanced visibility is achieved.

Further, in lieu of, or preferably, in addition to the application of highly reflective material on outer surface 26 of safety anchor enclosure 10, it is preferred that the exterior surface itself, be of a very bright color. Alternatively, the highly reflective material can be applied to the exterior of enclosure 10, in stripes or any other design or configuration. Ideally some eye-catching bright or reflective element is provided in such a manner that the reflected light or bright color can be detected from any angle of approach. This element of the invention will necessarily serve to better catch the attention of a person who is making their way along the dock, even with very minimal light. Thus, it is hopeful that this visual alert will facilitate complete avoidance of any collision of people with a boat anchor. However, in the worst of circumstances, if such an accidental contact should occur, when the described enclosure device is in its operative position the person making contact should escape with little or no harm at all.

As an alternative construction, straps 30 can be formed of a different material, such as the hook and loop version shown in FIG. 2, for example, which material can be sewn, glued, stitched, or otherwise securely affixed to outer surface material 26. When snuggly closed, anchor enclosure 10 is effectively water proof, or at least water resistant, thereby reducing the possibility of the anchor rusting and of mildew forming inside the safety enclosure. Further, because of the preferred materials of construction being buoyant, if enclosure 10 is accidentally dropped or kicked into the water, it will float and therefor can be easily retrieved.

With reference to FIG. 6, there is illustrated a flattened template for constructing an enclosure 10 in keeping with the invention. In the figure, the layer which will become outer surface 26 is facing upwardly. The template generally forms a cross shape, with the bottom 14 positioned vertically and centrally, and ends 20, 22 extending away from bottom 14, with enclosure end 22 seen at the top of the figure and enclosure end 20 at the bottom of the figure. Enclosure sides 16 and 18 extend to the left and right, respectively from bottom 14. A selvedge 38 is shown extending from the outer edges of the ends, sides and top of enclosure 10, which are positioned at substantially right angles, adjacent to one another, so that when those portions are stitched together, along seams 40, enclosure 10 will acquire an open box shape. The internal hinge indicated at 28 connects the right and left sides of the structure shown in FIG. 6 and is able to flex when it is desired to open enclosure 10. For safety enclosure 10 to be capable of opening in the desired manner, like a clamshell, it is necessary that ends 20, 22 each be split into two portions, such as along the lines indicated at 20C, 22C, respectively. By forming the ends into paired separable portions, which paired portions are each connected, forward and aft, to one of the opposed sides 16, 18, as paired top portions 12*a*, 12*b* are pulled laterally away from each other end portions 20*a*, 22*a*, necessarily separate from their respective partners, 20*b*, 22*b*, and begin to tilt outwardly and downwardly, along with their corresponding connected sides 18, 16 in the desired clamshell fashion, all the way to the point of intersection with opposed ends of the internal hinge. This construction proffers a sufficiently wide opening for easily receiving an anchor into the open top of enclosure 10. This preferred construction of the anchor safety enclosure also facilitates removal of enclosure 10 from beneath an anchor when it is time to make way.

A useful overall size of the new anchor enclosure is approximately 18 inches long and about 12 inches in height and 12 inches wide. As anchor sizes vary, however, so also can the new enclosure vary in overall size and relative dimensions. As a practical matter in manufacturing, the new anchor enclosure 10 can be provided, as a "standard," in a few common sizes with over-all dimensions that accommodate the most commonly used anchors and the corresponding openings 34 of those predetermined enclosure sizes can be sized and shaped to receive the most frequently used anchor shafts. Of course custom-made sizes of enclosure 10 could be provided if desired in the marketplace, to accommodate more infrequent sizes and shapes of anchors.

The above description of the preferred and practical embodiment(s) is merely exemplary in nature and is in no way intended to limit the invention, its application, or uses. It can be seen that anchor enclosure 10 can be economically constructed so that it can be priced well within an acceptable range for the majority of boat owners. Further, construction shown and described permits ready access to the spacious interior of enclosure 10, for purposes of installing anchor enclosure 10 beneath and upwardly around a boat anchor upon docking, or removing it there from when leaving the slip. In this manner it is assured that anytime the boat is at dock with the anchor extending over the upper, walking surface of the dock any pedestrians nearby are protected from accidental harm due to a collision with the protruding anchor.

Because of its light weight and simplicity of construction the new anchor enclosure it can be easily moved and handled by most adults and older children. These features provide the anchor safety enclosure with a very broad range of usefulness to more thoroughly fill the need in the marketplace to provide a safer anchor environment.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A safety enclosure for a boat anchor to prevent injury to persons moving about in the vicinity of the anchor when the boat is docked; the safety enclosure comprising:

an openable top; a bottom which is flexible along a longitudinal axis of the bottom; a first side extending from the top to the bottom; a second side opposite the first side and extending from the top to the bottom; a first end extending over an area defined by aft edges of the top, the bottom, the first side and the second side; a second end opposite the first end, the second end extending over an area defined by forward edges of the top, the bottom, the first side and the second side; the first end being positioned aft and defining an opening for receiving the shaft of an anchor on a boat, and the second end being positioned forward when the enclosure is in operative position enclosing the anchor of a boat;

wherein the openable top has a first portion and a second portion, wherein the first top portion and the second top portion are similarly sized and shaped and each have a forward edge and an aft edge, the first top portion and the second top portion each having an inner edge not connected to the inner edge of the other top portion; each of the first top portion and the second top portion having an outer edge; the first top portion and the second top portion being positioned side by side, with the openable top being closed when the anchor enclosure is in a closed configuration around an anchor;

the safety anchor enclosure being formed of at least one sheet of a durable, pliable material sufficiently strong to withstand repeated flexing and continual contact with heavy, sharp metal of a type forming an anchor of a boat; the at least one sheet of pliable material further being padded thickly enough to prevent serious harm to a person who movingly contacts the safety enclosed anchor;

the safety anchor enclosure further having at least one mechanism for securing the enclosure in a closed configuration when the enclosure is in operative position on the anchor of a boat.

2. The safety anchor enclosure of claim 1, wherein the first side and the second side each have an upper edge and a lower edge, the first side being positioned port and the second side being positioned starboard when the safety enclosure is in normal operative position enclosing the anchor of a boat, and further wherein the outer edge of the first top portion is connected to upper edge of the first/port side and the outer edge of the second top portion is connected to the upper edge of the second/starboard side.

3. The safety anchor enclosure of claim 2, wherein the enclosure bottom has an aft edge, a forward edge, a port edge and a starboard edge, in relation to the position of the safety enclosure in normal use position enclosing the anchor of a boat, the enclosure bottom having an internal hinge extending from the aft end to the forward end along a central longitudinal axis of the enclosure bottom to facilitate longitudinal flexing of the bottom;

and further wherein the first end of the enclosure and the second end of the enclosure are each divided longitudinally into a first/port end portion and a second/starboard end portion; the first and second end portions of each end are formed of similar sizes and shapes as the other portion of the pair; the first portion and the second portion of each of the first/aft end and the second/forward end having an upper edge, a lower edge, an inner edge, and an outer edge, the inner edges of each end portion pair being adjacent in the operative enclosure position, but selectively separable from one another; the inner edges of the first/aft end portions being substantial mirror images of each other, each defining a half of an opening, so as to form a complete opening when the first/aft end portions' inner edges are adjacent;

wherein the upper edge of the first/aft end portion is connected to the aft edge of the first/port top portion, and the upper edge of the second aft end portion is connected to the aft edge of the second/starboard top portion; the lower edges of both the first and second aft end portion connect side by side to the aft edge of the enclosure bottom; the outer edge of the first aft end portion is connected to the aft edge of the port side and the outer edge of the second aft end portion is connected to the aft edge of the starboard side;

wherein the upper edge of the first forward end portion is connected to the forward edge of the first/port top portion, and the upper edge of the second forward end portion is connected to the forward edge of the second/starboard top portion; the lower edges of both the first and second aft end portion connect side by side to the forward edge of the enclosure bottom; the outer edge of the first forward end portion is connected to the forward edge of the port side and the outer edge of the second forward end portion is connected to the forward edge of the starboard side;

wherein the upper edge of the second/forward end portion connects to the forward edge of the second top portion, and the upper edge of the starboard side connects to the outer edge of the second top portion; the aft edge of the second top portion connects to the upper edge of the second/aft end portion;

whereby the safety anchor enclosure includes one continuous selectively separable line of intersection of the two aft end portions, two top portions and two forward end portions contiguous with the internal hinge formed in the enclosure bottom, to thereby permit the safety anchor enclosure to be easily, repeatedly, and selectively opened and closed in a clamshell manner to enclose an anchor on a boat for safety at a boat dock, and to be selectively removed from the anchor when the boat is to leave the dock.

4. The safety anchor enclosure of claim 1, wherein the padding of the at least one sheet of durable, pliable material of which the enclosure is made is a floatable padding layer disposed interior of the at least one sheet of durable pliable material.

5. The anchor enclosure of claim 4, wherein the at least one sheet of durable, pliable material of which the enclosure is made includes a further layer of durable pliable material disposed interior of the floatable padding layer such that the padding layer is sandwiched between two layers of the durable pliable material.

6. The safety enclosure of claim 1, wherein the durable pliable material of which the safety enclosure is formed is water-resistant and mildew resistant.

7. The safety enclosure of claim 4, wherein the floatable padding layer is made of high-density foam.

8. The safety anchor enclosure of claim 1, wherein the top of the enclosure is formed of two sheets of substantially identical size, each shaped as an elongated rectangle, the two sheets being disposed flat and side by side, but separate with respect to one another.

9. The safety anchor enclosure of claim 5, wherein the at least one sheet of the material of the enclosure is covered separately by the material sealed to the high-density substance of the anchor enclosure, such that the two portions of the enclosure top can be spatially separated one from the other in order to define an opening in the top of the enclosure.

10. The safety anchor enclosure of claim 1, wherein the at least one mechanism for securing the enclosure in a closed configuration is a plurality of straps to selectively retain the inner edges of the top portions next to or overlapping each other, the inner edges of the forward end portions next to or overlapping each other, and the inner edges of the aft end portions next to or overlapping each other.

11. The safety anchor enclosure of claim 10, wherein the plurality of straps is formed of webbing material with quick-release buckles.

12. The safety anchor enclosure of claim 11, wherein an additional strap on each of the aft end portions has a metal ring secured for connection thereto of one metal ring to the other with a padlock to help maintain the padlock in connection to each of the first and second aft portions around the shaft and thereby discourage theft of the safety enclosure.

13. The safety anchor enclosure of claim 10, wherein the plurality of straps is formed of hook and loop fastener material.

14. The safety anchor enclosure of claim 1, wherein the outer surface of the safety enclosure further comprises areas of highly reflective material.

15. The safety anchor enclosure of claim 13, wherein the highly reflective material is strips of reflective tape applied to the outer surface of the safety enclosure.

16. The safety anchor enclosure of claim 1, wherein at least portions of the outer surface of the safety enclosure are provided with a highly visible neon color.

17. The safety anchor enclosure of claim 1, wherein the durable, pliable material is at least water resistant.

18. The safety anchor enclosure of claim 1, wherein the durable pliable material is mildew resistant.

19. A safety enclosure for a boat anchor to prevent injury to persons moving about in the vicinity of the anchor when the boat is docked; the safety enclosure comprising:

an openable top; a bottom which is flexible along a longitudinal axis of the bottom; a first side extending from the top to the bottom; a second side opposite the first side and extending from the top to the bottom; a first end extending over an area defined by aft edges of the top, the bottom, the first side and the second side; a second end opposite the first end, the second end extending over an area defined by forward edges of the top, the bottom, the first side and the second side; the first end being positioned aft and defining an opening for receiving the shaft of an anchor on a boat, and the second end being positioned forward when the enclosure is in operative position enclosing the anchor of a boat;

wherein the first side extends from the bottom toward and incorporates a first portion of the top so as to form a half of an arc, and the second side extends upwardly from the bottom toward and incorporates a second portion of the top, so as to form another half of an arc facing the first half of the arc, such that an end view of the forward or aft end of the enclosure is a half oval shape;

the safety anchor enclosure being formed of at least one sheet of a durable, pliable material sufficiently strong to withstand repeated flexing and continual contact with heavy, sharp metal of a type forming an anchor of a boat; the at least one sheet of pliable material further being padded thickly enough to prevent serious harm to a person who movingly contacts the safety enclosed anchor;

the safety anchor enclosure further having at least one mechanism for securing the enclosure in a closed configuration when the enclosure is in operative position on the anchor of a boat.

20. A safety anchor enclosure for a boat anchor to prevent injury to persons moving about in the vicinity of the anchor when the boat is docked; the safety anchor enclosure comprising:

an openable top; a bottom which is flexible along a longitudinal axis of the bottom; a first side extending from the top to the bottom; a second side opposite the first side and extending from the top to the bottom; a first end extending over an area defined by aft edges of the top, the bottom, the first side and the second side; a second end opposite the first end, the second end extending over an area defined by forward edges of the top, the bottom, the first side and the second side; the first end being positioned aft and defining an opening for receiving the shaft of an anchor on a boat, and the second end being positioned forward when the enclosure is in operative position enclosing the anchor of a boat;

wherein both the first side and the second side are formed so as to arc in one direction toward and incorporate the top enclosure and to arc in the opposite direction toward and incorporating the bottom of the enclosure, so that each of the two ends of the enclosure are circular and the overall shape of the enclosure is that of a barrel;

the safety anchor enclosure being formed of at least one sheet of a durable, pliable material sufficiently strong to withstand repeated flexing and continual contact with heavy, sharp metal of a type forming an anchor of a boat; the at least one sheet of pliable material further being padded thickly enough to prevent serious harm to a person who movingly contacts the safety enclosed anchor;

the safety anchor enclosure further having at least one mechanism for securing the enclosure in a closed configuration when the enclosure is in operative position on the anchor of a boat.

21. A safety enclosure for a boat anchor to prevent injury to persons moving about in the vicinity of the anchor when the boat is docked; the safety enclosure comprising:

an openable top; a bottom which is flexible along a longitudinal axis of the bottom; a first side extending from the top to the bottom; a second side opposite the first side and extending from the top to the bottom; a first end extending over an area defined by aft edges of the top, the bottom, the first side and the second side; a second end opposite the first end, the second end extending over an area defined by forward edges of the top, the bottom, the first side and the second side; the first end being positioned aft and defining an opening for receiving the shaft of an anchor on a boat, and the second end being positioned forward when the enclosure is in operative position enclosing the anchor of a boat;

wherein both the first side and the second side are flat and rectangular, connected at top edges to opposed sides of a flat, rectangular top portion and connected at bottom edges thereof to opposed sides of an internal hinge, wherein the bottom of the safety enclosure consist essentially of the internal hinge and the bottom edges of the two sides, the ends of the enclosure being triangular and the overall shape of the enclosure being a triangular prism;

the safety anchor enclosure being formed of at least one sheet of a durable, pliable material sufficiently strong to withstand repeated flexing and continual contact with heavy, sharp metal of a type forming an anchor of a boat; the at least one sheet of pliable material further being padded thickly enough to prevent serious harm to a person who movingly contacts the safety enclosed anchor;

the safety anchor enclosure further having at least one mechanism for securing the enclosure in a closed configuration when the enclosure is in operative position on the anchor of a boat.

22. A safety anchor enclosure to reduce risk of serious injury to pedestrians who might inadvertently collide with a boat anchor when the boat is at dock, comprising: an enclosure constructed of a high-density substance, the enclosure having an outer surface and an inner surface, the enclosure further having a top and a bottom, a front end and a back end and a first side and a second side, the first side and the second side connecting the front end to the back end and the top end to the bottom end; the back end of the enclosure defining an opening to receive the shaft of an anchor when the anchor enclosure is disposed in operative position completely enclosing an anchor on a boat.

23. A method of protecting persons moving about on a boat dock from injury due to accidental contact with a boat anchor extending over the dock surface; the method comprising the steps of:

a) providing a safety anchor enclosure having an openable top; a bottom which is flexible along a longitudinal axis of the bottom; a first side extending from the top to the bottom; a second side opposite the first side and extending from the top to the bottom; a first end extending over an area defined by aft edges of the top, the bottom, the first side and the second side; a second end opposite the first end, the second end extending over an area defined by forward edges of the top, the bottom, the first side and the second side; the first end being positioned aft and defining an opening for receiving the shaft of an anchor on a boat, and the second end being positioned forward when the enclosure is in operative position enclosing the anchor of a boat; the safety enclosure being formed of at least one sheet of a durable, pliable material sufficiently strong to withstand repeated flexing and continual contact with heavy, sharp metal of a type forming an anchor of a boat; the at least one sheet of pliable material further being padded thickly enough to prevent serious harm to a person who movingly contacts the safety enclosed anchor; the safety enclosure further having at least one mechanism for securing the enclosure in a closed configuration when the enclosure is in operative position on the anchor of a boat;

b) separating the top of the safety enclosure;

c) placing the open top of the safety enclosure longitudinally beneath the anchor of a boat to which the anchor is attached;

d) placing the opening in the aft end of the safety enclosure around the anchor shaft;

e) closing the safety enclosure around the anchor by urging one side of the safety enclosure toward the other side of the safety enclosure;

f) drawing straps on paired sides of the safety enclosure toward a center longitudinal axis; and securing the paired safety enclosure sides with hook and loop fastener; webbed straps and by metal loops secured to the webbed straps for optional addition of a padlock to the safety enclosure for an anchor to prevent injury to person moving about in the vicinity of the anchor when the boat is docked.

* * * * *